US005479745A

United States Patent [19]

Kawai et al.

[11] Patent Number: 5,479,745

[45] Date of Patent: Jan. 2, 1996

[54] FLOOR PANEL SUPPORT LEG AND DOUBLE FLOOR

[75] Inventors: Yoshinari Kawai, Hyougo; Fumihiro Oyama, Osaka; Mikio Yamagishi, Tokyo, all of Japan

[73] Assignee: Sumitomo Rubber Industries, Ltd., Kobe, Japan

[21] Appl. No.: 229,795

[22] Filed: Apr. 19, 1994

[30] Foreign Application Priority Data

Apr. 21, 1993 [JP] Japan ..... 5-117748

[51] Int. Cl.[6] ..... E04B 9/00

[52] U.S. Cl. ..... 52/126.6; 52/126.1; 52/126.7

[58] Field of Search ..... 52/126.6, 126.7, 52/126.5, 126.1, 125.6, 125.1, 263

[56] References Cited

U.S. PATENT DOCUMENTS 4,780,577 10/1988 Huang ..... 52/126.6 X

*Primary Examiner*—Carl D. Friedman
*Assistant Examiner*—Creighton Smith
*Attorney, Agent, or Firm*—Kanesaka & Takeuchi

[57] ABSTRACT

Floor panel support legs support floor panels atop a floor slab and a double floor device uses such floor panel support legs. Each floor support leg is constituted by a pair of cylindrical first and second pedestal members and a fixing member for fixing the relative position between the first and second pedestal members, the first and second pedestal members having bottoms at their axial one end portions and thread portions at their inner and outer circumferential surfaces respectively so that they are thread-engaged with each other through their thread portions. The axial height of the support leg is set by the degree of thread engagement between the first and second pedestal members and the thus set height is fixed by the fixing member. Such support legs are arranged between a floor slab and floor panels at butted portions of the floor panels to support the floor panels to thereby constitute a double floor device. Thus, the support legs are capable of strongly supporting floor panels at a low position from a floor slab to thereby provide a low double floor device.

9 Claims, 3 Drawing Sheets

FLOOR PANEL SUPPORT LEG AND DOUBLE FLOOR

BACKGROUND OF THE INVENTION

1. Field of the Invention

The present invention relates to support a leg designed to support a plurality of floor panels at a predetermined interval from a floor slab, and to a double floor which is supported by these support legs. More particularly, the present invention relates to a floor panel support leg which stably and firmly supports the butted portions of a plurality of floor panels at a low position above the floor slab, and to a double floor which is supported by these support legs.

2. Description of the Related Art

In recent years, due to the introduction of a plurality of office automation machines not only in computer rooms, but also in ordinary offices, it has become necessary to arrange several types of communication cables and electric cables on the floor. In conventional offices, communication and power source plug sockets are provided on walls and pillars, and it is necessary to trail the connecting cables on the floor from the plug sockets to the place of equipment installation. Yet, when these cables are exposed on the floor, it is possible that during walking one's foot may inadvertently be caught and pull out a plug of a connecting cable, or there is the danger that a connecting cable may be 'severed by the pressure under other machinery or by the passage of a push cart, etc.

Thus, double floors called "free access floors" have been widely adopted in recently constructed buildings, and particularly in this type of office quarters. This type of double floor is explained by an example shown in FIG. 4. For example, a plurality of quadrangular floor panels 1 in each of which one side is in a range of from 150 to 1000 mm and the thickness is in a range of from 15 to 50 mm are prepared. A plurality of support legs are provided vertically on a floor slab 2 at intervals from each other approximately correspondingly to the length of one side of the floor panel 1. Then, the floor panels 1 are laid down on the floor slab 2 so that the respective corner portions of four adjacent floor panels 1 are supported by the tip of one support leg 3. By this means, space is created between the floor panels 1 and the floor slab 2, so that floor communication cables and electric power cables, or interface equipment for the distributors and employed equipment can be arranged in this space under the floor. Further, plug sockets can be provided on the floor panels near the installed machinery or apparatus, and the distance of the cables or the like which are exposed on the floor can be shortened to the minimum. Moreover, the floor panels 1 can be easily removably attached and changes in layout following installation can be adequately coped with.

Yet, since the double floor is arranged at a predetermined height from the floor slab in the aforementioned manner, the height from the surface of the floor to the ceiling is lowered in comparison to the ordinary floor design, so that one may feel an oppressive sensation. In the case of newly constructed buildings, however, in consideration of the height of the double floor, it is possible to execute in advance a design so as to make the height from the floor slab to the ceiling sufficiently high so as to thereby remove this feeling of oppression, but in the case where a double floor is installed in an already existing building, this feeling of oppression cannot be removed. Thus, it is desirable to have a low double floor with a height of, for example, 50 mm or less. For this purpose, if the height of the support leg which supports the floor panels is lowered, the height of the double floor also becomes low, so that not only it is possible to remove the feeling of oppression to thereby implement this double floor in existing buildings, but also it is possible to lower the height to the ceiling in the case of newly constructed buildings to thereby contribute to the effective utilization of space. As shown in FIG. 4, in the case where the support leg 3 is constituted by a lower pedestal 4 which is disposed on the floor slab 2, a screw shaft 5 provided at the center of this lower pedestal 4 so as to constitute a support column, a screw sleeve 6 to which this screw shaft 5 is screwed, and an upper pedestal 7 which has the screw sleeve 6 at its lower side and which supports the floor panels 1 at its top surface, the floor panels 1 can be supported at a low position with the lowered height of the screw shaft 5. Yet, for example, if the height of the support leg 3 is lowered so that the height of the double floor is made to be 50 mm or less, the thread-engagement portion of the screw shaft 5 and the screw sleeve 6 becomes correspondingly shorter, the support of the floor panels 1 becomes unstable, and the strength becomes insufficient. Thus, with the conventional pedestal support method, it has been impossible to make the height of the double floor approximately lower than 60 mm.

A double floor has been proposed where a plurality of mats of predetermined thickness are arranged on a floor slab with certain intervals between the adjacent mats; cables are made to pass through these intervals and the respective upper portions of the intervals are closed with a covering material; and a carpet is then laid over the mats and the intervals so as to cover them. In this way, by replacing the support legs and floor panels with the carpet and mats which support the carpet in plane, and by adjusting the thickness of the mats, it is possible to obtain a double floor with a height of 50 mm or less. As another example, a proposal has been made so that a support in which a plurality of height-adjustable columns at the underside of a thin tabular body of approximately the same size as a floor panel is provided in the form of an individual support unit in which one floor panel is fastened to and supported by one support. There are no pedestals, and the screw fitting member can be made long, with the result that it is possible to obtain a double floor with a height 50 mm or less.

Among these proposals, however, in the case of the former, since it is necessary to lay mats over the entire floor slab which forms the double floor and to fill the intervals between the mats with cover material, there is a defect that the number of parts becomes very large. Moreover, since the mats are spread over the floor slab, the manufacturing precision of the floor slab directly influences the finished product, it is necessary to give the floor slab an extremely flat finish, and much care must be taken to manufacture the floor slab. Furthermore, there is such a defect that there is an opening only for cables between the mats, and air conditioning cannot be conducted under the floor.

With regard to the latter proposal, since each floor panel is supported by an independent column, in the case where the level of the floor panels is adjusted, at least the columns of the four corners must be adjusted and the adjustment is troublesome. Further, it becomes necessary to redo the level adjustment whenever a change is made in the orientation of the floor panels. Furthermore, there is a defect that, when the floor panels are removed at the time of cable installation, the cables near the columns are easily moved, so that, when the floor panels are restored, the cables may become pressed under the columns to make the storage inconvenient, or the cables may be injured and broken.

SUMMARY OF THE INVENTION

Thus, an object of the present invention is to provide a floor panel support leg capable of strongly supporting the corner portions of a plurality of butted floor panels so that the height of the double floor can be made to be less than 50 mm, this height being adjustable.

In order to attain the above object, according to an aspect of the present invention, a floor panel support leg for supporting butted portions of a plurality of floor panels atop a floor slab, comprises: an approximately cylindrical first pedestal member having a bottom portion and an opened end portion respectively formed at one end side and the other end side in its axial direction, and further having a first thread portion formed in its outer circumferential surface; an approximately cylindrical second pedestal member having an opened end portion and a bottom portion respectively formed at one end side and the other end side in its axial direction, and further having a second thread portion formed in its inner circumferential surface, the first pedestal member being inserted from its opened end side into the second pedestal member from its opened end side so that the first thread portion is thread-engaged with the second thread portion; and a fixing member for fixing the first and second pedestal members in a condition where the first and second pedestal members are in thread engagement with each other to thereby prevent the first and second pedestal members from moving relatively to each other.

Preferably, the fixing member includes: a fixed hollow screw member erectly fixed to a center portion of the bottom portion of selected one of the first and second pedestal members, the fixed hollow screw member having a third thread portion formed in its inner circumferential surface; and a solid screw member having a fourth thread portion formed on its outer circumferential surface, the solid screw member being screwed into the fixed hollow screw member through an opening formed at a center portion of the bottom portion of the other one of the first and second pedestal members so that the fixed hollow screw member and the solid screw member are thread-engaged with each other through the third and fourth thread portions.

In the above-configuration, the axial length of the first pedestal member is selected to be shorter than the axial length of the second pedestal member so that the minimum support height of the floor panels from the floor slab is defined by the axial length of the second pedestal member.

According to another aspect of the present invention, a double floor device provided on top of a floor slab, comprises: a plurality of floor panels; a plurality of support legs of the type as mentioned above according to the one aspect of the present invention.

Preferably, each of the support legs is arranged so that the bottom portion of one of the first and second pedestal members is arranged on top of the floor slab, and the butted portions of the floor panels are supported by the bottom portion of the other one of the first and second pedestal members.

Preferably, a cushioning member may be provided between the bottom portion of the one of the first and second pedestal members and the butted portions of the floor panels.

According to the present invention, the height of the support leg becomes lowest when the first pedestal member is fully screwed onto the second pedestal member, and becomes highest when the lower end of the thread portion of the first pedestal member is thread-engaged with only the upper end of the thread portion of the second pedestal member. Between the lowest and highest heights, the height can be continually changed by relatively turning the first and second pedestal members in the clockwise/counterclockwise direction. Since the support leg has an approximately cylindrical shape and its external diameter is approximately equal to the size of the pedestals, its stability is superior and its strength can be raised even when its axial length is short. In the case where the height is set to the maximum, since the engaged portions of the respective thread portions of the first and second pedestal members are supported at least at their center portions by the fixing member, the strength can be maintained, and the floor panels do not become shaky. Accordingly, the floor panels can be supported at, for example, 50 mm or less. Furthermore, since contact is made with the floor slab over a wide area, it is easy to absorb the unevenness or bumpiness of the floor slab.

By making the axial length of the first pedestal member shorter than the axial length of the second pedestal member, the lowest height becomes substantially equal to the axial length of the second pedestal member, and the floor panels can be supported at a lower level.

Furthermore, with regard to the double floor, since the butted portions of a plurality of floor panels are supported by a support leg whose height is fixed by the thread-engaged first and second pedestal members and the fixing member which fixes the relative positions of these two pedestal members, the floor panels can be supported in a low position from the floor slab. When an irregularity occurs in the height of a support leg due to the unevenness or bumpiness of the floor slab, it is possible to adjust the height of the support leg of that portion alone, and it is therefore possible to reduce the time for fabrication. Further, it is possible to provide a cushioning material or the like between the floor panels and the upper end of the support leg to provide a comfortable walking sensation.

DESCRIPTION OF THE PREFERRED EMBODIMENTS

Figure 1:
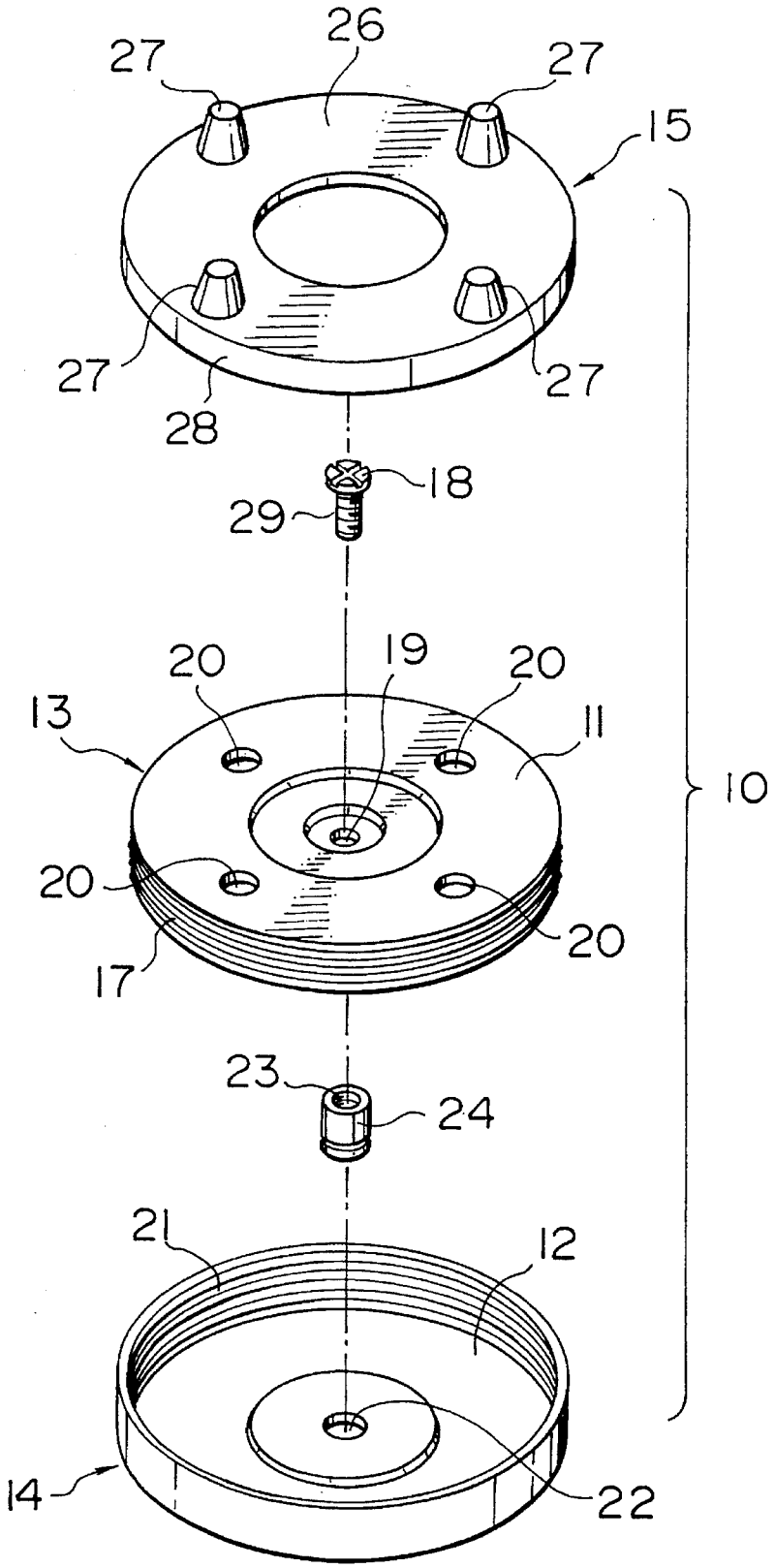
FIG. 1 is an exploded perspective view which shows an embodiment of the support leg according to the present invention in a disassembled state.

Below, the present invention will be described about embodiments illustrated in drawings. First, referring to FIG. 1 and FIG. 2, an embodiment of the floor panel support leg will be described.

A support leg 10 is mainly constituted by: a pair of cylindrical first and second pedestal members 13 and 14 each of which is made of a metal plate and which are opened at their axially one end portions and blocked at their axially other end portions by bottom portions 11 and 12 respectively; a cushioning member 15 made from rubber or elastic synthetic resin, or the like, and attached to the bottom portion 11 of the first pedestal member 13; and a fixing member 16 for fixing the relative position between the first and second pedestal members 13 and 14.

The outer diameter of the first pedestal member 13 is made slightly smaller than the inner diameter of the second pedestal member 14 so as to be closely fitted to the inside of the second pedestal member 14. Moreover, the axial length of the first pedestal member 13 is made shorter than that of the second pedestal member 14. A first thread portion 17 is formed in the outer circumferential surface of the first pedestal member 13, and with regard to the second pedestal member 14, a second thread portion 21 is formed in its inner circumferential surface so as to be able to thread-engage with the thread portion 17 of the first pedestal member 13.

The fixing member 16 is constituted by a bolt-like solid screw member 18 having a third thread portion 29 formed in its outer circumferential surface and a sleeve-like or nut-like fixed hollow screw member 24 having a fourth thread portion 23 formed in its inner circumferential portion so that the solid screw member 18 and the hollow screw member 24 are able to thread-engage with each other at their thread portions 29 and 23. An opening 19 is formed approximately at a center portion of the bottom portion 11 of the first pedestal member 13 so that the thread portion 29 of the solid screw member 18 can be inserted and passed through this opening 19. An opening 22 is formed approximately at a center portion of the bottom portion 12 of the second pedestal member 14 and the lower end portion of the fixed hollow screw member 24 is fixedly attached in an erect manner at this opening 22 by caulking or by any other suitable means. After the first and second pedestal members 13 and 14 are thread-engaged with each other, the solid screw member 18 is passed through the opening 19 of the bottom portion 11 and screwed into the fixed hollow screw member 24. The central portion of the bottom portion 11 is made somewhat concave so that the head of the solid screw member 18 does not project out. In order to eliminate any projection of the head of the solid screw member 18, it is preferable to use a counter-sunk screw with a flat head. The central portion of the bottom portion 12 is also made somewhat concave so that the lower end of the fixed hollow screw member 24 does not project out.

In the first pedestal member 13, four openings 20 are formed so as to surround the opening 19 so that the four openings act as escape holes for excess adhesive material at the time of adhesive attachment of the cushioning member 15 to the bottom portion 11. Moreover, at the time of the machining of the thread portion 17, the openings 20 may be used to chuck the first pedestal member 13.

Figure 2:
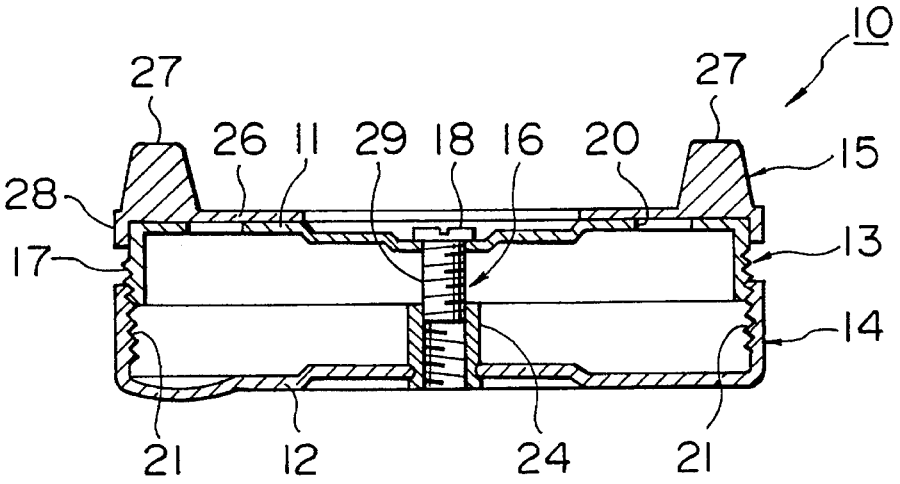
FIG. 2 is a vertical sectional view of the state where the support leg embodiment is assembled.

In FIG. 2, a part of the bottom portion 12 projects downward at the left side in the drawing. This is made for the reason, for example that, in the case where there is unevenness in a floor slab 25 on which the support leg 10 is positioned so that the bottom portion 12 cannot be horizontally positioned on the floor slab 25, the illustrated part of the bottom portion 12 is made to project by means of a punch or the like (not shown) so as to bring about leveling. This type of work is conducted on site.

The cushioning member 15 which is attached onto the bottom portion 11 of the first pedestal member 13 is integrally constituted by a donut-shaped disk portion 26 with an outer diameter which is approximately equal to the outer diameter of the first pedestal member 13, four claw members 27 which are erectly provided approximately at equal angular intervals of 90° on the top surface of the disk portion 26, and a rim portion 28 which extends downward from the outer circumferential portion of the disk portion 26. This cushioning member 15 is normally arranged by simply fitting it in the bottom portion 11 of the first pedestal member 13, but according to necessity it may be fixed to the bottom portion 11 by an adhesive material.

After the mutual thread-engagement between the first and second pedestal members 13 and 14 is adjusted to thereby set the axial height of the support leg 10, the solid screw member 18 is screwed into the fixed hollow screw member 24 to thereby fix the relative position between the first and second pedestal members 13 and 14. That is, the first and second pedestal members 13 and 14 are prevented from turning relative to each other by the fixing member 16. Thus, even if there is some vibration, the first and second pedestal members 13 and 14 do not turn relatively to each other.

The axial height of this support leg 10 becomes lowest when the first pedestal member 13 is fully screwed into the second pedestal member 14, and becomes highest when only the lower end of the thread portion 17 of the first pedestal member 13 is engaged with the upper end of the thread portion 21 of the second pedestal member 14. Between these lowest and highest heights, the height of the support leg 10 can be continuously changed by turning the first and second pedestal members 13 and 14 relatively to each other in the clockwise/counterclockwise direction. Thus, since the support leg 10 is approximately cylindrical and the outer diameter of the support leg is approximately equally to the size of the pedestals, the stability of the support leg 10 is excellent, the strength of the support leg 10 can be raised even if its axial height of the support leg 10 is low, and in the case where the thread engagement of the respective thread portions 17 and 21 of the first and second pedestal members 13 and 14 is made minimum to make the height of the support leg 10 maximum, the strength can be maintained by the multiplier effect with the fixing member 16. Consequently, it is possible to set the height of the double floor to 50 mm or less. That is, in the case where the axial length of the second pedestal member 14 is set at 23 mm, if the axial length of the first pedestal member 13 is made to be 2 to 3 mm shorter than the second pedestal member 14, and if the axial length of the engagement portion of each thread portion 17 and 21 at the time of maximum height is set to about 3 mm, it is possible to provide a support leg 10 where the maximum height is about 41 mm, the minimum height is about 23 mm, and an optional height can be selected in between the maximum and minimum heights. Furthermore, if short settings are adopted where, for example, the axial length of the first pedestal member 13 is 12 mm and the axial length of the second pedestal member 14 is set to 15 mm, it is possible to provide a low support leg 10 where the maximum height is 24 mm and the minimum height is 15 mm.

Figure 3:
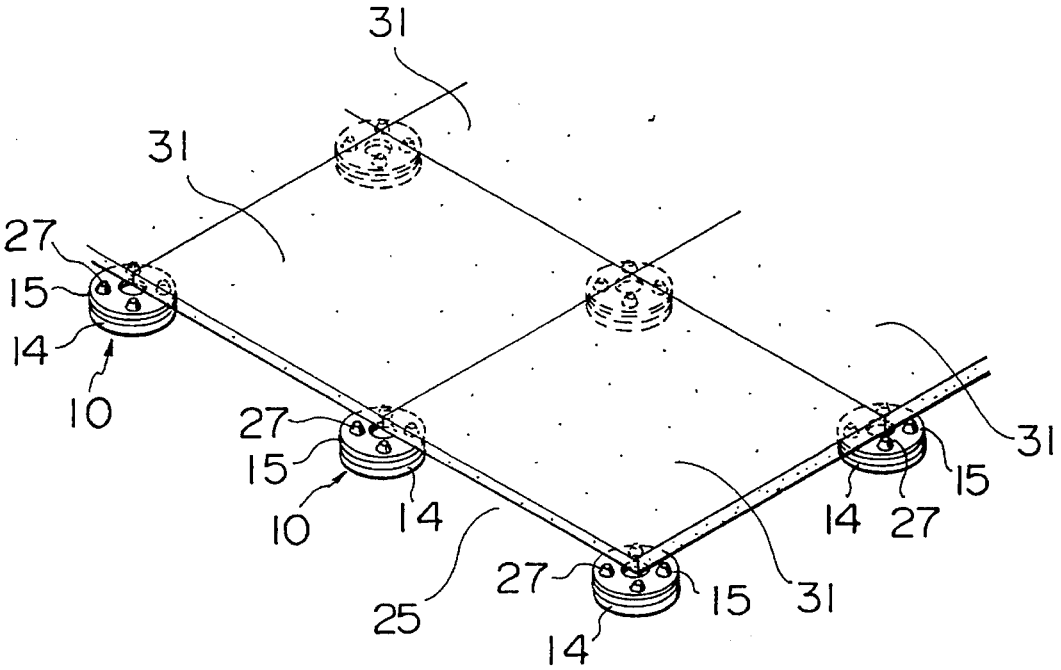
FIG. 3 is a partial perspective view which shows an example of a double floor which is supported by the support legs of this embodiment.
Figure 4:
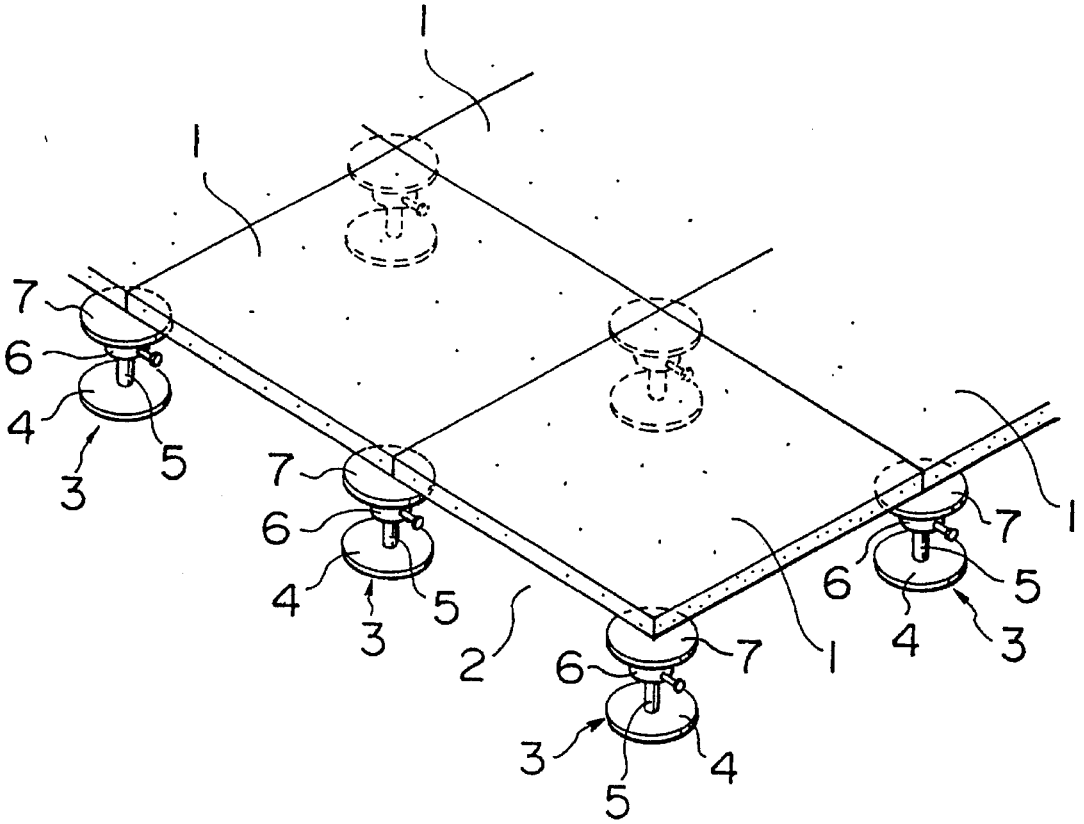
FIG. 4 PRIOR ART
FIG. 4 is a partial perspective view which shows an example of a conventional double floor.

Next, FIG. 3 is used to explain the case where floor panels 31 are supported above a floor slab 25 by this type of support legs 10. Each floor panel 31 is a square which has one side in a range of 150 to 1000 mm and a thickness in a range of from 15 to 50 mm. The floor panel 31 is constituted by upper and lower plate materials and a panel material of concrete or calcium silicate interposed between the upper and lower plate materials; or constituted by upper and lower plate materials and arranged such that numerous bumps are formed on the lower plate member and the tips of the convex portions of the lower plate member are fixed to the bottom face of the upper plate member, the space created by the upper and lower plate members being filled with the above-mentioned panel material; or constituted by a thin steel plate called GRC steel plate and reinforced concrete laminated on the steel plate, the concrete being strengthened by glass fiber; or constituted by a conventionally well known floor panel consisting of aluminum die cast or unitary steel.

With regard to the supporting of these floor panels 31 at a preset height from the floor slab 25, first, the height of each support leg 10 is adjusted to a predetermined height. As stated above, this adjustment can be very easily conducted by turning one of the first and second pedestal members 13 and 14 relative to the other. When the adjustment is terminated, the solid screw member 18 is inserted into the opening 19 of the bottom portion 11 of the first pedestal member 13, and screwed into the fixed hollow screw member 24 so as to be fixed firmly. As a result of this, there is no turning of the first and second pedestal members 13 and 14 relative to each other. The support leg 10 whose height has been preadjusted in this manner is arranged on the floor slab 25 at a position corresponding to the butted portions of the respective floor panels 31. Next, with regard to the butted corner portions of the four floor panels 31, the respective floor panels 31 are fixed to the support leg 10 by inserting the claw members 27 of the cushioning member 15 into the engagement holes (not shown) which are formed at the corner portions underside of the respective floor panels 31.

In the case where, at the preadjusted height, a floor panel 31 projects up or falls below another floor panel due to the unevenness or bumpiness of the floor slab 25, a worker may remove the floor panel 31 at the place in question, take out the support leg 10 of that portion, and adjust the height after loosening the solid screw member 18. In the case in which there is a local concavity in the floor slab 25 where a part of the bottom portion 12 of the second pedestal member 14 becomes shaky, as stated above and as shown in FIG. 2, a part of the bottom portion 12 may be made to project downward. With regard to this type of leveling, the part of the bottom portion 12 may be struck with a punch, or the like, so as to be projected. In this case, if a punch mount for receiving the bottom portion 12 of the second pedestal member 14 is prepared and if various holes of differing depth of, for example, 0.5 mm, 1.00 mm and 1.5 mm are formed in advance in the bottom face of the punch mount, a worker can select one of the holes correspondingly to the depth of the concavity, place the bottom portion 12 in the punch mount, and strike the bottom portion 12 from above with the punch to thereby easily form a projection of a predetermined height on the bottom portion 12. In this manner, the floor panels 31 can be supported at a low height of 50 mm or less from the floor slab 25.

As stated above, the support leg according to the present invention is constituted by an approximately cylindrical first pedestal member which at least has a bottom portion at one end in its axial direction, a similarly cylindrical second pedestal member which is able to thread-engage with the first pedestal member, and a fixing member for fixing these first and second pedestal members. Accordingly, the outline of the cylindrical shape is approximately equal to the size of the pedestals, stability is improved, and strength can be raised even if the axial length is short. Moreover, even in the case where the height is at maximum so that the engaged portions of the thread portions of the first and second pedestal members are less, the strength can be maintained because the first and second pedestal portions are supported also at their center portions by the fixing member. Accordingly, the floor panels do not become shaky. Thus, it is possible to obtain a double floor with a height of, for example, 50 mm or less. Furthermore, height adjustment can be conducted by a simple operation merely by turning either one of the first and second pedestal members, and absorption of the unevenness or bumpiness of floor slab becomes easy.

By making the axial length of the first pedestal member shorter than the axial length of the second pedestal member, the lowest height of the support leg becomes substantially equal to the axial length of the second pedestal member, and the floor panels can be supported at a lower level.

Furthermore, since the double floor of the present invention has a structure in which butted portions of a plurality of floor panels are supported on a floor slab by means of a support leg whose height is determined by thread-engagement between first and second pedestal members and fixed by a fixing member for fixing the relative positions of these two pedestal members, the floor panels can be supported at a low position from the floor slab. Moreover, when irregularities occur in the height of the support legs due to the unevenness or bumpiness of the floor slab, since it is sufficient to adjust the height of only the support leg of that portion, the manufacturing time can be shortened. Further, since cushioning members or the like can be provided between the panels and the upper ends of the support legs, it is possible to obtain a double floor with a comfortable walking sensation.

What is claimed is:

1. A floor panel support leg for supporting butted portions of a plurality of floor panels atop a floor slab, comprising:

an approximately cylindrical first pedestal member having a bottom portion and an opened end portion respectively formed at one end side and the other end side in an axial direction of the first pedestal member, and further having a first thread portion formed in an outer circumferential surface thereof;

an approximately cylindrical second pedestal member having an opened end portion and a bottom portion respectively formed at one end side and the other end side in an axial direction of the second pedestal member, and further having a second thread portion formed in an inner circumferential surface thereof, said first pedestal member being inserted from its opened end side into said second pedestal member from its opened end side so that said first thread portion is thread-engaged with said second thread portion; and a fixing member situated between the first and second pedestal members, said fixing member fixing said first and second pedestal members in a condition where said first and second pedestal members are in thread engagement with each other to thereby prevent said first and second pedestal members from moving relatively to each other.

2. A floor panel support leg according to claim 1, wherein said fixing member includes:

a fixed hollow screw member erectly fixed to a center portion of the bottom portion of selected one of said first and second pedestal members, said fixed hollow screw member having a third thread portion formed in its inner circumferential surface; and a solid screw member having a fourth thread portion formed on its outer circumferential surface, said solid screw member being screwed into said fixed hollow screw member through an opening formed at a center portion of the bottom portion of the other one of said first and second pedestal members so that said fixed hollow screw member and said solid screw member are thread-engaged with each other through said third and fourth thread portions.

3. A floor panel support leg according to claim 1, wherein the axial length of said first pedestal member is selected to be shorter than the axial length of said second pedestal member so that the minimum support height of said floor panels from said floor slab is defined by the axial length of said second pedestal member.

4. A floor panel support leg according to claim 1, wherein each of said bottom portions of the first and second pedestal members is a closed bottom portion, said fixing member being arranged in center portions of the closed bottom portions to immovably connect the first and second pedestal members.

5. A double floor device provided on top of a floor slab, comprising:

a plurality of floor panels;

a plurality of support legs for supporting butted portions of said floor panels above said floor slab, each of said support legs including:

an approximately cylindrical first pedestal member having a bottom portion and an opened end portion respectively formed at one end side and the other end side in an axial direction of the first pedestal member, and further having a first thread portion formed in an outer circumferential surface thereof;

an approximately cylindrical second pedestal member having an opened end portion and a bottom portion respectively formed at one end side and the other end side in an axial direction of the second pedestal member, and further having a second thread portion formed in an inner circumferential surface thereof, said first pedestal member being inserted from its opened end side into said second pedestal member from its opened end side so that said first thread portion is thread-engaged with said second thread portion; and a fixing member situated between the first and second pedestal members, said fixing member fixing said first and second pedestal members in a condition where said first and second pedestal members are in thread engagement with each other to thereby prevent said first and second pedestal members from moving relatively to each other.

6. A double floor device according to claim 5, wherein said fixing member includes:

a fixed hollow screw member erectly fixed to a center portion of the bottom portion of selected one of said first and second pedestal members, said fixed hollow screw member having a third thread portion formed in its inner circumferential surface; and a solid screw member having a fourth thread portion formed on its outer circumferential surface, said solid screw member being screwed into said fixed hollow screw member through an opening formed at a center portion of the bottom portion of the other one of said first and second pedestal members so that said fixed hollow screw member and said solid screw member are thread-engaged with each other through said third and fourth thread portions.

7. A double floor device according to claim 5, wherein each of said support legs is arranged so that the bottom portion of one of said first and second pedestal members is arranged on top of said floor slab, and the butted portions of said floor panels are supported by the bottom portion of the other one of said first and second pedestal members.

8. A double floor device according to claim 7, wherein a cushioning member is provided between the bottom portion of said one of said first and second pedestal members and said butted portions of said floor panels.

9. A double floor device according to claim 4, wherein each of said bottom portions of the first and second pedestal members is a closed bottom portion, said fixing member being arranged in center portions of the closed bottom portions to immovably connect the first and second pedestal members.

* * * * *